US010657871B2

(12) United States Patent
Kim et al.

(10) Patent No.: US 10,657,871 B2
(45) Date of Patent: May 19, 2020

(54) TIMING CONTROLLER, DATA DRIVER, DISPLAY DEVICE, AND METHOD OF DRIVING THE DISPLAY DEVICE

(71) Applicant: LG DISPLAY CO., LTD., Seoul (KR)

(72) Inventors: Haneol Kim, Paju-si (KR); Moonky Yee, Goyang-si (KR); EunMyung Park, Paju-si (KR); Honggyu Kim, Uiwang-si (KR); Aran Sung, Daejeon (KR)

(73) Assignee: LG DISPLAY CO., LTD., Seoul (KR)

( * ) Notice: Subject to any disclaimer, the term of this patent is extended or adjusted under 35 U.S.C. 154(b) by 134 days.

(21) Appl. No.: 15/372,180

(22) Filed: Dec. 7, 2016

(65) Prior Publication Data

US 2017/0186358 A1 Jun. 29, 2017

(30) Foreign Application Priority Data

Dec. 28, 2015 (KR) ..... 10-2015-0187702

(51) Int. Cl.

| | |
|---|---|
| ***G09G 5/10*** | (2006.01) |
| ***G09G 3/20*** | (2006.01) |
| ***G09G 3/3233*** | (2016.01) |
| ***G09G 3/3258*** | (2016.01) |
| ***G09G 3/3266*** | (2016.01) |
| ***G09G 3/3291*** | (2016.01) |
| ***G09G 3/36*** | (2006.01) |

(52) U.S. Cl.

CPC ..... *G09G 3/2074* (2013.01); *G09G 3/20* (2013.01); *G09G 3/2007* (2013.01); *G09G 3/2018* (2013.01); *G09G 3/3233* (2013.01); *G09G 3/3258* (2013.01); *G09G 3/3266* (2013.01); *G09G 3/3291* (2013.01); *G09G 3/3607* (2013.01); *G09G 3/3677* (2013.01); *G09G 3/3688* (2013.01); *G09G 2300/0819* (2013.01); *G09G 2300/0842* (2013.01); *G09G 2310/08* (2013.01); *G09G 2320/0233* (2013.01); *G09G 2320/0276* (2013.01); *G09G 2320/0285* (2013.01); *G09G 2320/0295* (2013.01); *G09G 2320/043* (2013.01); *G09G 2320/045* (2013.01); *G09G 2320/0673* (2013.01)

(58) Field of Classification Search

None

See application file for complete search history.

(56) References Cited

U.S. PATENT DOCUMENTS

2007/0035707 A1* 2/2007 Margulis ..... G03B 21/26 353/122
2007/0052643 A1* 3/2007 Li ..... G09G 3/2007 345/89

(Continued)

FOREIGN PATENT DOCUMENTS

CN 101097319 A 1/2008
CN 101256748 A 9/2008

*Primary Examiner* — Carl Adams

(74) *Attorney, Agent, or Firm* — Dentons US LLP

(57) ABSTRACT

Disclosed are a data driver, a display device, and a method of driving the display device for improving the ability to express low-gray scale images. The method includes a shift process of shifting gray scale of input data by K gray scale and a data shift compensation process of reducing or preventing a luminance change using a shift gamma look-up table (LUT) so that a desired level of luminance can be generated.

8 Claims, 12 Drawing Sheets

(56) References Cited

U.S. PATENT DOCUMENTS

2008/0001880 A1* 1/2008 Ki-Min ..... G09G 3/2007
345/89
2008/0204482 A1* 8/2008 Kim ..... G09G 3/3611
345/690

* cited by examiner

TIMING CONTROLLER, DATA DRIVER, DISPLAY DEVICE, AND METHOD OF DRIVING THE DISPLAY DEVICE

CROSS REFERENCE TO RELATED APPLICATION

This application claims priority from Korean Patent Application No. 10-2015-0187702 filed on Dec. 28, 2015, which is hereby incorporated by reference for all purposes as if fully set forth herein.

BACKGROUND

Field

The present disclosure relates to a timing controller, a data driver, a display device, and a method of driving a display device.

Description of Related Art

In response to the development of information society, demand for a variety of display devices for displaying images is increasing. In this regard, a range of display devices, such as liquid crystal display (LCD) devices, plasma display panels (PDPs), and organic light-emitting display devices, have recently come into widespread use.

In such a display device, the brightness (luminance) of subpixels of a display panel is controlled depending on the gray scales of data, the subpixels to be controlled being selected by scanning signals.

A specific gray scale of image data may not be fully implemented in an image displayed on the display panel due to various reasons, such as a limited number of bits for data processing. Thus, the ability to express low-gray scale images may be reduced.

SUMMARY

Various aspects of the present disclosure provide a timing controller, a data driver, a display device, and a method of driving the display device that can improve the ability to express low-gray scale images.

Also provided are a timing controller, a data driver, a display device, and a method of driving the display that enable low-gray scale images to be expressed through data shifting.

Also provided are a timing controller, a data driver, a display device, and a method of driving the display that enable low-gray scale images to be expressed while obtaining desired levels of luminance.

According to an aspect of the present disclosure, a method for improving the ability to express low-gray scale images may include: a shift process of shifting gray scale of input data by K gray scale; and a data shift compensation process of preventing a luminance change using a shift gamma look-up table (LUT) so that a desired level of luminance is generated.

According to another aspect of the present disclosure, a display device may include: a display panel on which a number of data lines, a number of gate lines, and a number of subpixels defined by the number of data lines and the number of gate lines are disposed; a data driver circuit driving the number of data lines; a gate driver circuit driving the number of gate lines; and a timing controller controlling the data driver circuit and the gate driver circuit.

In the display device, the timing controller may shift data having n gray scale into data having m gray scale greater than the n gray scale by K gray scale, where the n is a real number equal to or greater than 0, the K is a positive integer, and the m is n+K, and transfer the data having the m gray scale to the data driver circuit.

In the display device, the data driver circuit may receive the data having the m gray scale and output a data voltage for expressing the n gray scale to a corresponding data line among the number of data lines.

According to a further aspect of the present disclosure, provided is a method of driving a display device, the display device including a display panel on which a number of data lines, a number of gate lines, and a number of subpixels defined by the number of data lines and the number of gate lines are disposed, a data driver circuit driving the number of data lines, a gate driver circuit driving the number of gate lines, and a timing controller controlling the data driver circuit and the gate driver circuit.

The driving method may include: receiving data having n gray scale, where the n is a real number equal to or greater than 0; shifting the data having the n gray scale into data having m gray scale greater than the n gray scale by K gray scale, where the K is a positive integer, and the m is n+K; and expressing the n gray scale using the data having the m gray scale by referring to a shift gamma LUT.

According to another aspect of the present disclosure, a timing controller may include: a data input circuit receiving data having n gray scale, where the n is a real number equal to or greater than 0; a data shifting circuit shifting the data having the n gray scale to data having m gray scale greater than the n gray scale by K gray scale, where the K is a positive integer, and the m is n+K; and a data output circuit outputting the data having the m gray scale.

According to a further aspect of the present disclosure, a data driver may include: a data receiving circuit receiving data having m gray scale; and a data voltage output circuit converting the data having the m gray scale into a data voltage for expressing n gray scale smaller than the m gray scale by K gray scale by referring to a shift gamma LUT, where the K is a positive integer, and the n is m−K, and outputting the data voltage to a corresponding data line.

According to exemplary embodiments, the timing controller, the data driver, the display device, and the method of driving the display device can improve the ability to express low-gray scale images.

In addition, according to exemplary embodiments, the timing controller, the data driver, the display device, and the method of driving the display device enable low-gray scale images to be expressed through data shifting.

Furthermore, according to exemplary embodiments, the timing controller, the data driver, the display device, and the method of driving the display device enable low-gray scale images to be expressed while obtaining desired levels of luminance.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION OF THE ILLUSTRATED EMBODIMENTS

Figure 1:
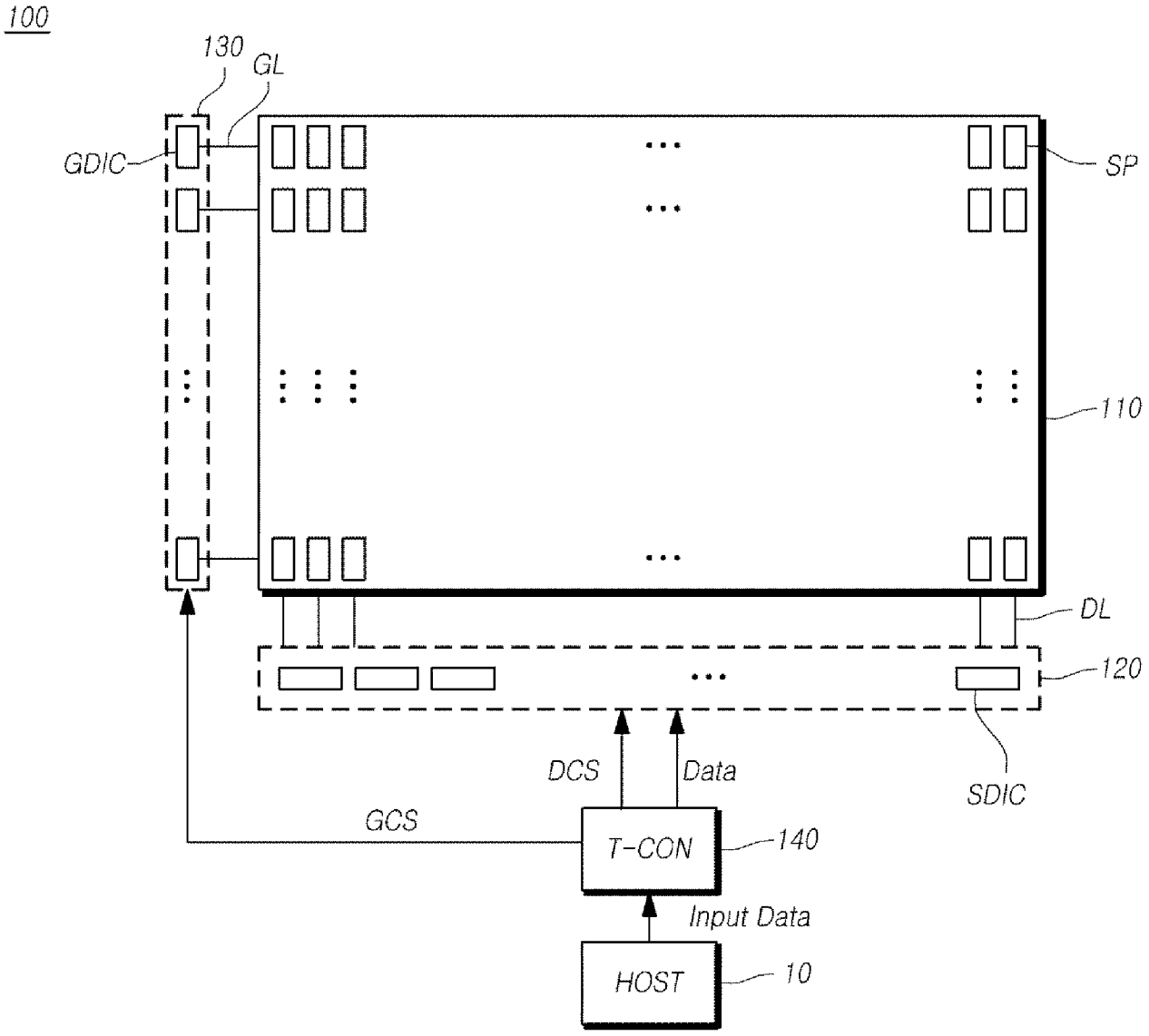
FIG. 1 is a schematic view illustrating the configuration of a display device 100 according to exemplary embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic view illustrating the configuration of a display device 100 according to exemplary embodiments.

Referring to FIG. 1, the display device 100 according to exemplary embodiments includes a display panel 110 on which a number of data lines DL and a number of gate lines GL are disposed. In addition, on the display panel, a number of subpixels SP are defined in the form of a matrix by the number of data lines DL and the number of gate lines GL. The display device 100 further includes a data driver circuit (or a data driver) 120 driving the number of data lines DL, a gate driver circuit (or a gate driver) 130 driving the number of gate lines GL, and a timing controller (or T-CON) 140 controlling the data driver circuit 120 and the gate driver circuit 130.

The timing controller 140 controls the data driver circuit 120 and the gate driver circuit 130 by supplying a variety of control signals to the data driver circuit 120 and the gate driver circuit 130.

The timing controller 140 starts scanning based on timing realized by each frame, converts input data corresponding to image data input by a host 10 into a data signal format readable by the data driver circuit 120, outputs the converted image data, and controls data processing at a suitable point in time in response to the scanning.

The data driver circuit 120 drives the number of data lines DL by supplying data voltages to the number of data lines DL. Herein, the data driver circuit 120 is also referred to as a "source driver circuit."

The data driver circuit 120 may include one or more source driver circuits (SDICs).

The gate driver circuit 130 sequentially drives the number of gate lines GL by sequentially supplying scanning signals to the number of gate lines GL. Herein, the gate driver circuit 130 is also referred to as a "scanning driver circuit."

The gate driver circuit 130 may include one or more gate driver integrated circuits (GDICs).

The gate driver circuit 130 sequentially supplies scanning signals, respectively having an on or off voltage, to the number of gate lines GL under the control of the timing controller 140.

When a specific gate line is opened by the gate driver circuit 130, the data driver circuit 120 converts data received from the timing controller 140 into analog data voltages and supplies the analog data voltages to the number of data lines DL.

Although the data driver circuit 120 is positioned on one side of (e.g. above or below) the display panel 110 in FIG. 1, the data driver circuit 120 may be positioned on both sides of (e.g. above and below) the display panel 110 depending on the driving system, the design, and so on.

Although the gate driver circuit 130 is positioned on one side (e.g. to the right or left) of the display panel 110 in FIG. 1, the gate driver circuit 130 may be positioned on both sides (e.g. to right and left) of the display panel 110 depending on the driving system, the design, and so on.

The timing controller 140 receives a variety of timing signals together with the input data from the host 10, the variety of timing signals including a vertical synchronization signal Vsync, a horizontal synchronization signal Hsync, an input data enable (DE) signal, and a clock signal.

The timing controller 140 generates a variety of control signals by receiving the variety of timing signals, including a vertical synchronization signal Vsync, a horizontal synchronization signal Hsync, an input data enable (DE) signal, and a clock signal, and outputs the variety of control signals to the data driver circuit 120 and the gate driver circuit 130 to drive the data driver circuit 120 and the gate driver circuit 130.

For example, the timing controller 140 outputs a variety of gate control signals (GCSs) including a gate start pulse (GSP), a gate shift clock (GSC), and a gate output enable (GOE) signal to control the gate driver circuit 130.

Here, the GSP controls the operation start timing of one or more GDICs of the gate driver circuit 130. The GSC is a clock signal commonly input to the one or more GDICs to control the shift timing of a scanning signal (gate pulse). The GOE signal designates the timing information of the one or more GDICs.

In addition, the timing controller 140 outputs a variety of data control signals (DCSs) including a source start pulse (SSP), a source sampling clock (SSC), and a source output enable (SOE) signal to control the data driver circuit 120.

Here, the SSP controls the data sampling start timing of one or more SDICs of the data driver circuit 120. The SSC is a clock signal controlling the data sampling timing of the one or more SDICs. The SOE signal controls the output timing of the data driver circuit 120.

Each of the SDICs of the data driver circuit 120 may be connected to the bonding pads of the display panel 110 by tape-automated bonding (TAB) or chip-on-glass (COG) bonding, may be directly disposed on the display panel 110, or in some cases, may be integrated with the display panel 110. Alternatively, each of the SDICs may be mounted on a film connected to the display panel 110 by a chip-on film (COF) method.

Each of the SDICs includes a shift register, a latch circuit, a digital-to-analog converter (DAC), an output buffer, and so on.

In some cases, each of the SDICs may further include an analog-to-digital converter (ADC).

Each of the GDICs of the gate driver circuit 130 may be connected to the bonding pads of the display panel 110 by tape-automated bonding (TAB) or chip-on-glass (COG) bonding, may be implemented as a gate-in-panel (GIP)-type IC directly disposed on the display panel 110, or in some cases, may be integrated with the display panel 110. Alternatively, each of the GDICs may be mounted on a film connected to the display panel 110 by a chip-on film (COF) method.

Each of the GDICs includes a shift register, a level shifter, and so on.

The display device 100 according to exemplary embodiments may include one or more source printed circuit boards (S-PCBs) for circuit-connection to the data driver circuit 120 and a control printed circuit board (C-PCB) on which control components and a variety of electronic devices are mounted.

Each of the S-PCBs may have one or more SDICs mounted thereon or may be connected to a film on which one or more SDICs are mounted.

The C-PCB may have the timing controller 140, a power timing controller, and so on mounted thereon. The timing controller 140 controls the operations of the data driver circuit 120, the gate driver circuit 130, and so on, while the power timing controller supplies a variety of voltages or currents to or controls the supply of the variety of voltages or currents to the display panel 110, the data driver circuit 120, the gate driver circuit 130, and so on.

The circuits of the one or more S-PCBs may be connected to the circuit of the C-PCB by means of one or more connecting members.

The connecting members may be a flexible printed circuit (FPC), a flexible flat cable (FFC), or the like.

The one or more S-PCBs and the C-PCB may be integrated as a single printed circuit board (PCB).

The display device 100 according to exemplary embodiments may be a device selected from among, but not limited to, a liquid crystal display (LCD) device, an organic light-emitting display device, a plasma display device, and so on.

The structures of the subpixels SP disposed on the display panel 110 may vary depending on the types of the display device 100.

For example, when the display device 100 is an LCD device, each of the subpixels SP includes a pixel electrode and a transistor. The transistor is connected between the pixel electrode and a corresponding data line, is controlled by a scanning signal supplied from a corresponding gate line, and delivers a data voltage supplied from the data line to the pixel electrode.

In another example, when the display device 100 is an organic light-emitting display device, each of the subpixels SP includes an organic light-emitting diode (OLED) and circuit components, such as a driving transistor, to drive the OLED.

The types and number of the circuit components of each subpixel SP may be determined variously depending on the functions, the design, and so on.

Figure 2:
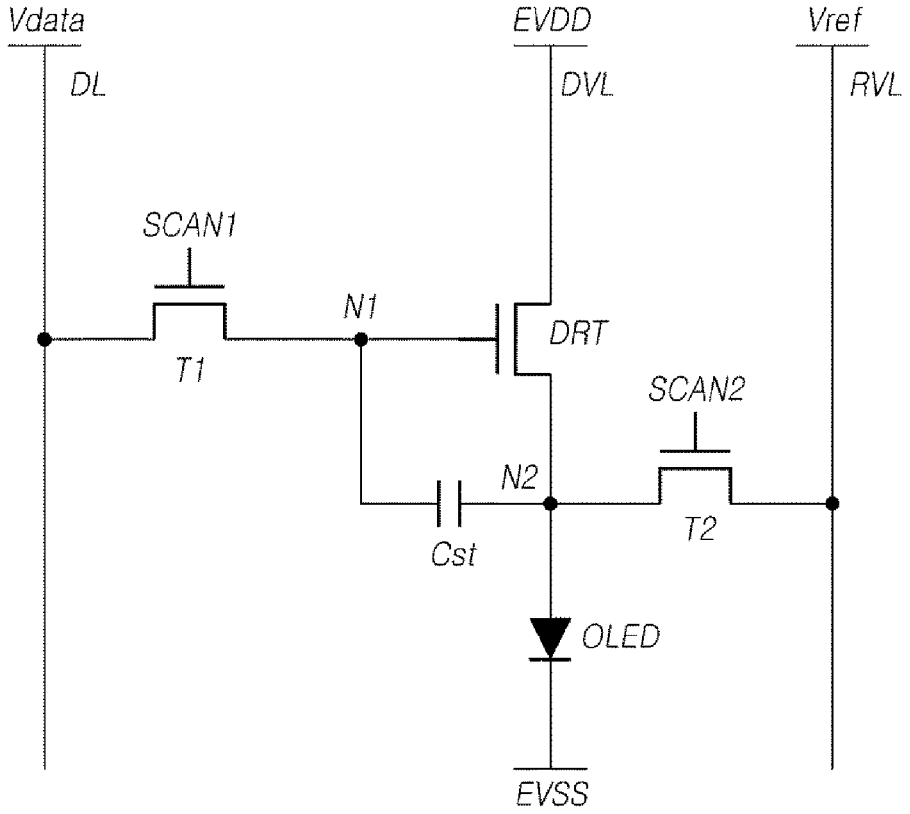
FIG. 2 is a schematic view illustrating an exemplary subpixel structure of the display device according to exemplary embodiments.

FIG. 2 is a schematic view illustrating an exemplary subpixel structure of the display device 100 according to exemplary embodiments.

FIG. 2 illustrates an example of the structure of each subpixel SP in the case that the display device 100 according to exemplary embodiments is an organic light-emitting display device.

Referring to FIG. 2, the subpixel SP basically includes an organic light-emitting diode (OLED), a driving transistor DRT driving the OLED, a first transistor T1 controlled by a first scanning signal SCAN1 to deliver a data voltage Vdata to a first node N1 corresponding to the gate node of the driving transistor DRT, and a storage capacitor Cst maintaining a data voltage corresponding to an image signal voltage or a voltage corresponding to the data voltage for a period of a single frame.

The subpixel SP further includes a second transistor T2 to control the voltage of the second node N2 of the driving transistor DRT and sense the characteristic values of the driving transistor DRT or the OLED.

The OLED includes a first electrode (e.g. an anode), an organic layer, a second electrode (e.g. a cathode), and so on.

The driving transistor DRT drives the OLED by supplying a driving current to the OLED.

In the driving transistor DRT, the first node N1 may be electrically connected to the source node or the drain node of the first transistor T1 or may be a gate node. The second node N2 may be electrically connected to the first electrode of the OLED or may be a source node or a drain node. The third node N3 may be electrically connected to a driving voltage line DVL through which a driving voltage EVDD is supplied or may be a drain node or a source node.

The first transistor T1 is electrically connected between the data line DL and the first node N1 of the driving transistor DRT, and is controlled by a first scanning signal SCAN1 applied to the gate node thereof through a gate line.

The first transistor T1 can be turned on by the first scanning signal SCAN1 to deliver the data voltage Vdata, supplied from a data line DL, to the first node N1 of the driving transistor DRT.

The second transistor T2 is electrically connected between the second node N2 of the driving transistor DRT and a reference voltage line RVL through which a reference voltage Vref is supplied, and is controlled by a second scanning signal SCAN2, a type of scanning signal applied to the gate node thereof.

The second transistor T2 is turned on by the second scanning signal SCAN2 to apply the reference voltage Vref, supplied through the reference voltage line RVL, to the second node of the driving transistor DRT.

The storage capacitor Cst is electrically connected between the second node N2 and the first node N1 of the driving transistor DRT.

The storage capacitor Cst is not a parasitic capacitor (e.g. Cgs or Cgd), i.e. an internal capacitor formed between the second node N2 and the first node N1 of the driving transistor DRT, but is an external capacitor intentionally designed to be disposed outside of the driving transistor DRT.

The driving transistor DRT, the first transistor T1, and the second transistor T2 may be embodied as n-type transistors or p-type transistors.

The first scanning signal SCAN1 and the second scanning signal SCAN2 may be separate gate signals. In in this case, the first scanning signal SCAN1 and the second scanning signal SCAN2 may be applied to the gate node of the first transistor T1 and the gate node of the second transistor T2 through different gate lines.

Alternatively, the first scanning signal SCAN1 and the second scanning signal SCAN2 may be the same gate signals. In this case, the first scanning signal SCAN1 and the second scanning signal SCAN2 may be applied to the gate node of the first transistor T1 and the gate node of the second transistor T2 through the same gate line.

The driving transistor DRT, the first transistor T1, and the second transistors T2 may be embodied as n-type transistors or p-type transistors.

Here, light may not be generated by a subpixel that receives data having a specific gray scale or less, due to limitations, such as the limited number of bits for data processing of the timing controller 140. Thus, the ability to express low-gray scale images may be reduced.

In this regard, exemplary embodiments propose a novel method for expressing low gray scales, the method being able to improve the quality of images by preventing the ability to express low gray scales from being reduced.

Hereinafter, first, a phenomenon in which the ability to express images having low gray scales is reduced and reasons for the phenomenon will be briefly described with reference to FIG. 3 and FIG. 4.

Figure 3:
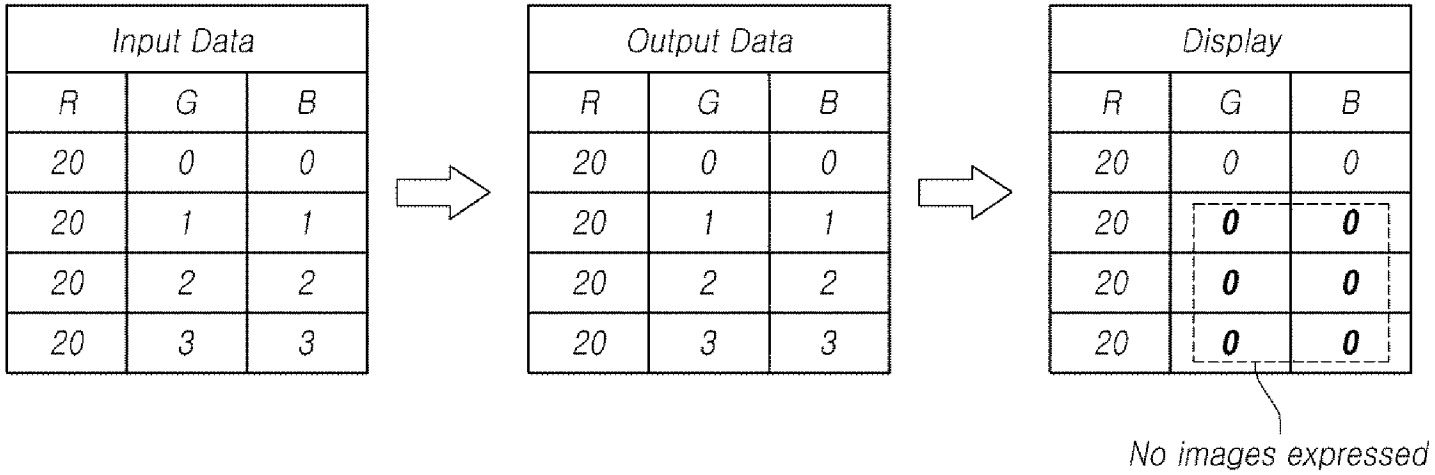
FIG. 3 and FIG. 4 illustrate a phenomenon in which the ability to express images having low gray scales is reduced.
Figure 4:
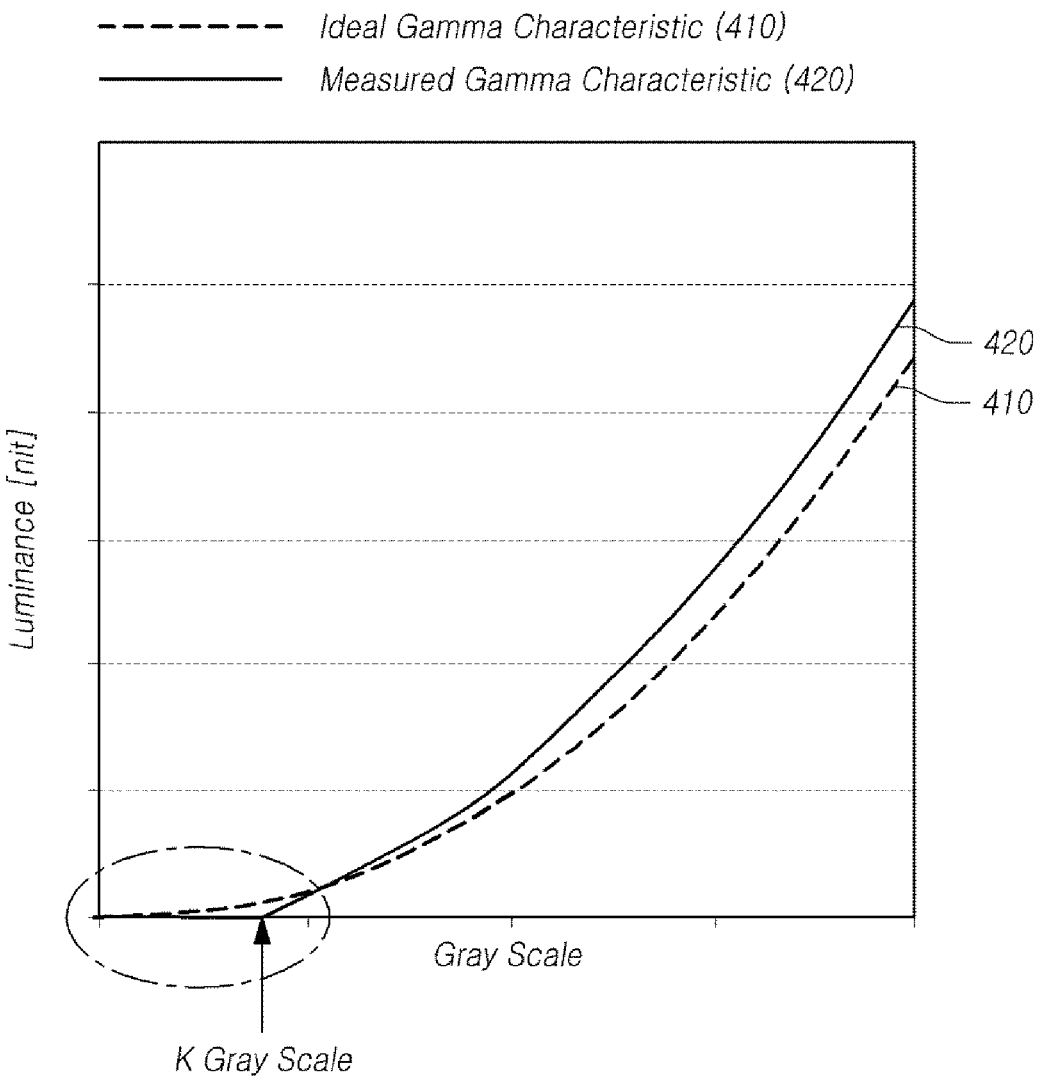

FIG. 3 and FIG. 4 illustrate the phenomenon in which the ability to express images having low gray scales is reduced.

FIG. 3 illustrates the gray scales of input data for twelve subpixels input to the timing controller 140, the gray scales of output data for the twelve subpixels output from the timing controller 140, and the gray scales of the twelve subpixels that are actually displayed.

FIG. 4 illustrates gamma characteristics based on gray scale and luminance (nit), in which a gamma characteristic curve 410 shown with a dotted line represents an ideal gamma characteristic, while a gamma characteristic curve 420 shown with a solid line represents an actually-measured gamma characteristic.

Referring to FIG. 3, according to existing display methods, the timing controller 140 outputs input data directly, as output data.

Thus, data having a specific gray scale or less is processed as data having zero gray scale in data processing, due to the limited number of bits for data processing.

In the case that the display device 100 is an organic light-emitting display device having the subpixel structure illustrated in FIG. 2 or a subpixel structure modified therefrom, the driving transistor DRT of the subpixel SP to which data having zero gray scale is supplied is not turned on, whereby light is not generated.

Thus, as illustrated in FIG. 3 and FIG. 4, a subpixel may not express an image using data having specific K gray scale or less.

The specific K gray scale acting as a reference based on which an image is not expressed may vary depending on, for example, the number of bits of data that the timing controller 140 or the SDIC can process.

For example, when input data are eight bits, 1 gray scale is converted into $(1/255)^{22}$ for 2.2 gamma processing, and a final value may vary depending on the number of bits that the timing controller 140 can internally process. When bits that the timing controller 140 can internally process are 14 bits, an output value is $(1/255)^{22}\times 2^{14}$, which is to be rounded.

Thus, an output value of 1 gray scale is 0, since 1 gray scale is about 0.008, which is rounded off to 0. In addition, an output value of 2 gray scale is 0, since 2 gray scale is about 0.382, which is rounded off to 0.

In addition, an output value of 3 gray scale is 0, since 3 gray scale is about 0.932, which is rounded off to 1. Thus, it is theoretically possible to express images having 3 gray scale or more. However, images having 3 gray scale may not be expressed due to various factors, such as panel deviations.

Such degradation in the ability to express low-gray scale images can be overcome when the number of bits that the timing controller 140 can internally process is significantly increased. However, this solution may be difficult to perform in terms of technology, cost, and the like, since specific measures, such as memory enlargement and the high-performance design of the timing controller 140, may be required.

Although viewers may not easily recognize differences in brightness on a bright screen, such degradations in the ability to express low-gray scale images may cause significant degradations in the quality of images, when considering the characteristics of human vision that enable humans to easily recognize differences in brightness on a dark screen.

Hereinafter, a method for improving the quality of images by preventing the ability to express low-gray scale images from being reduced will be described with reference to FIGS. 5 to FIG. 9.

Figure 5:
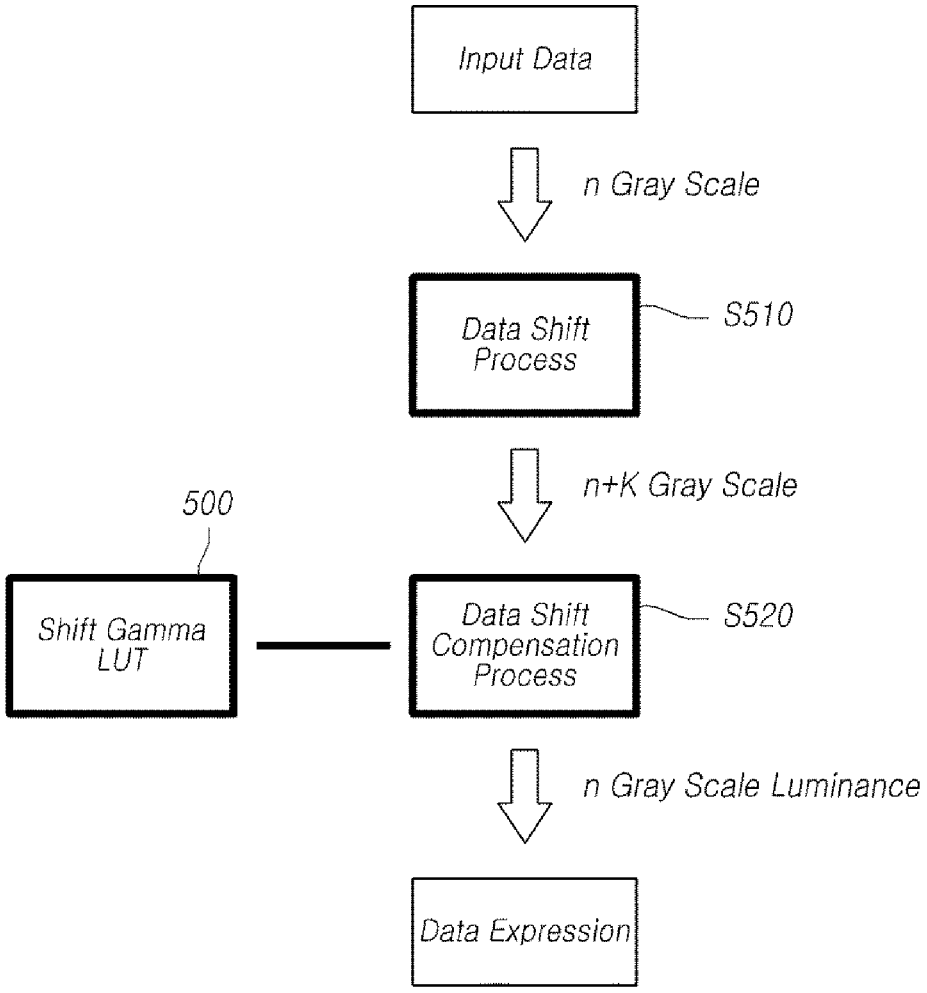
FIG. 5 illustrates a method for improving the ability to express low-gray scale images of the display device according to exemplary embodiments.

FIG. 5 illustrates a method for improving the ability to express low-gray scale images of the display device 100 according to exemplary embodiments.

Figure 6:
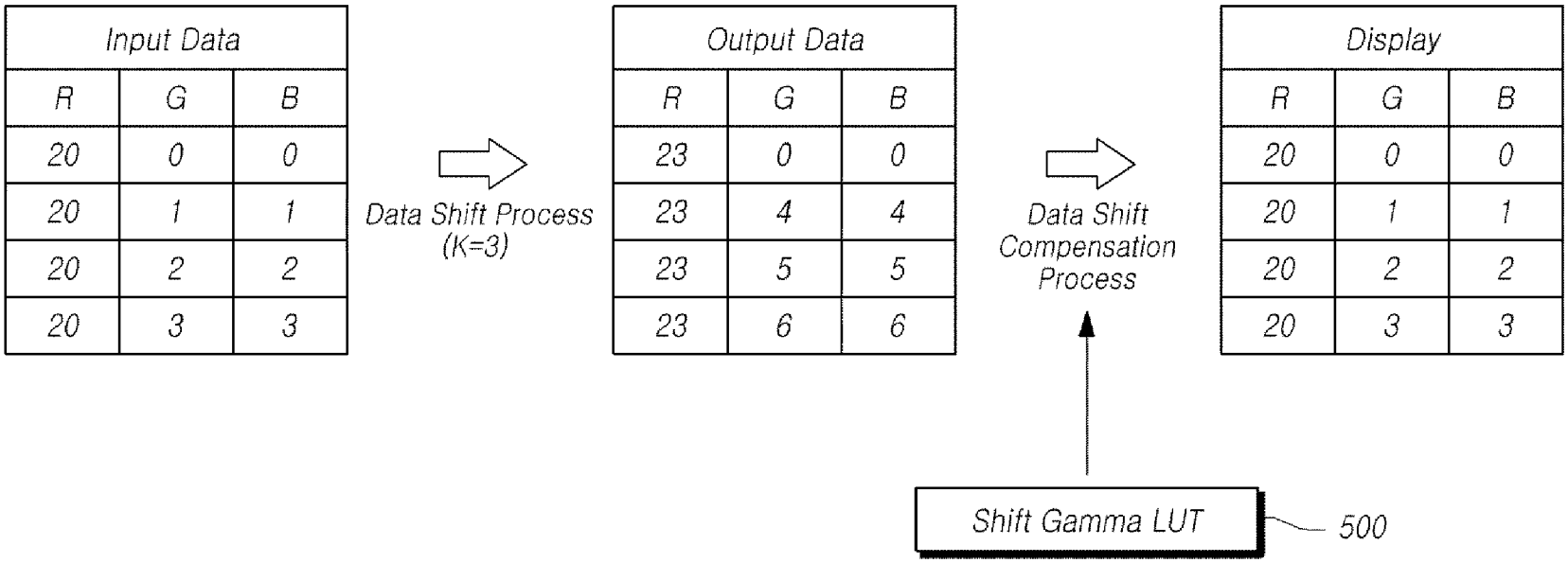
FIG. 6 illustrates an example in which the ability to express low-gray scale images of the display device according to exemplary embodiments is improved.

FIG. 6 illustrates an example in which the ability to express low-gray scale images of the display device 100 according to exemplary embodiments is improved.

Figure 7:
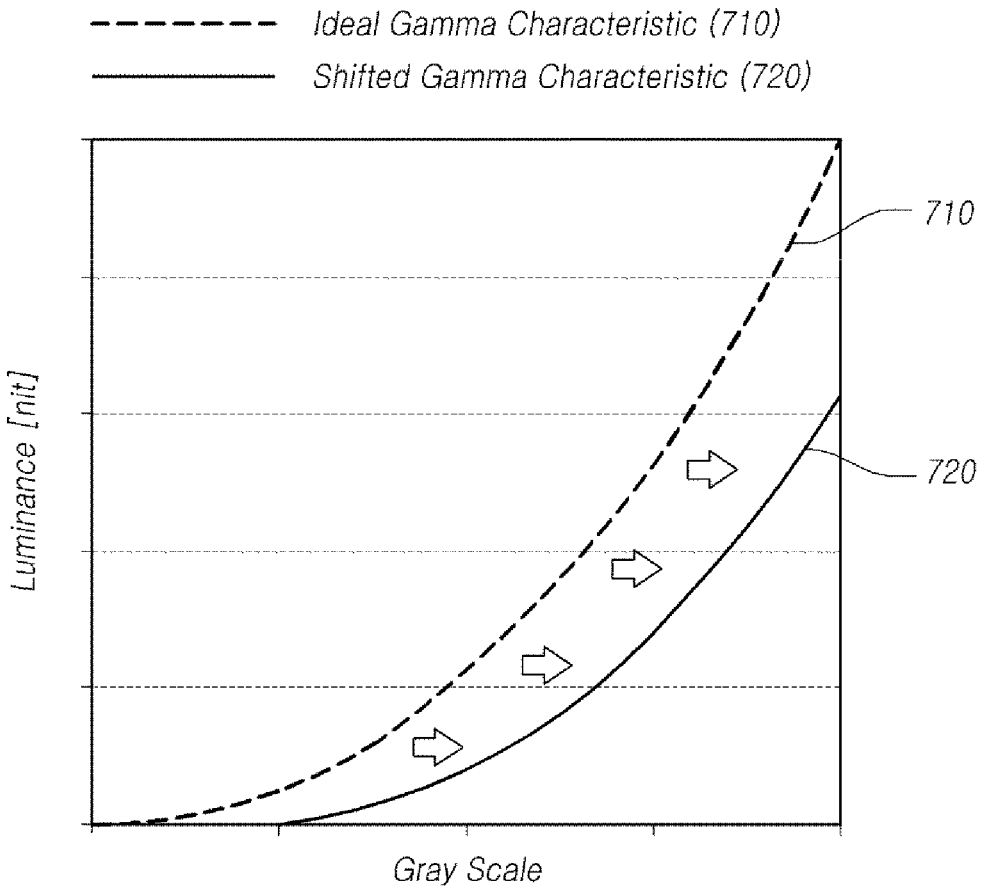
FIG. 7 is a gray scale-luminance characteristic graph illustrating a gamma characteristic shifted by data shifting using the method for improving the ability to express low-gray scale images of the display device according to exemplary embodiments and an ideal gamma characteristic.
Figure 8:
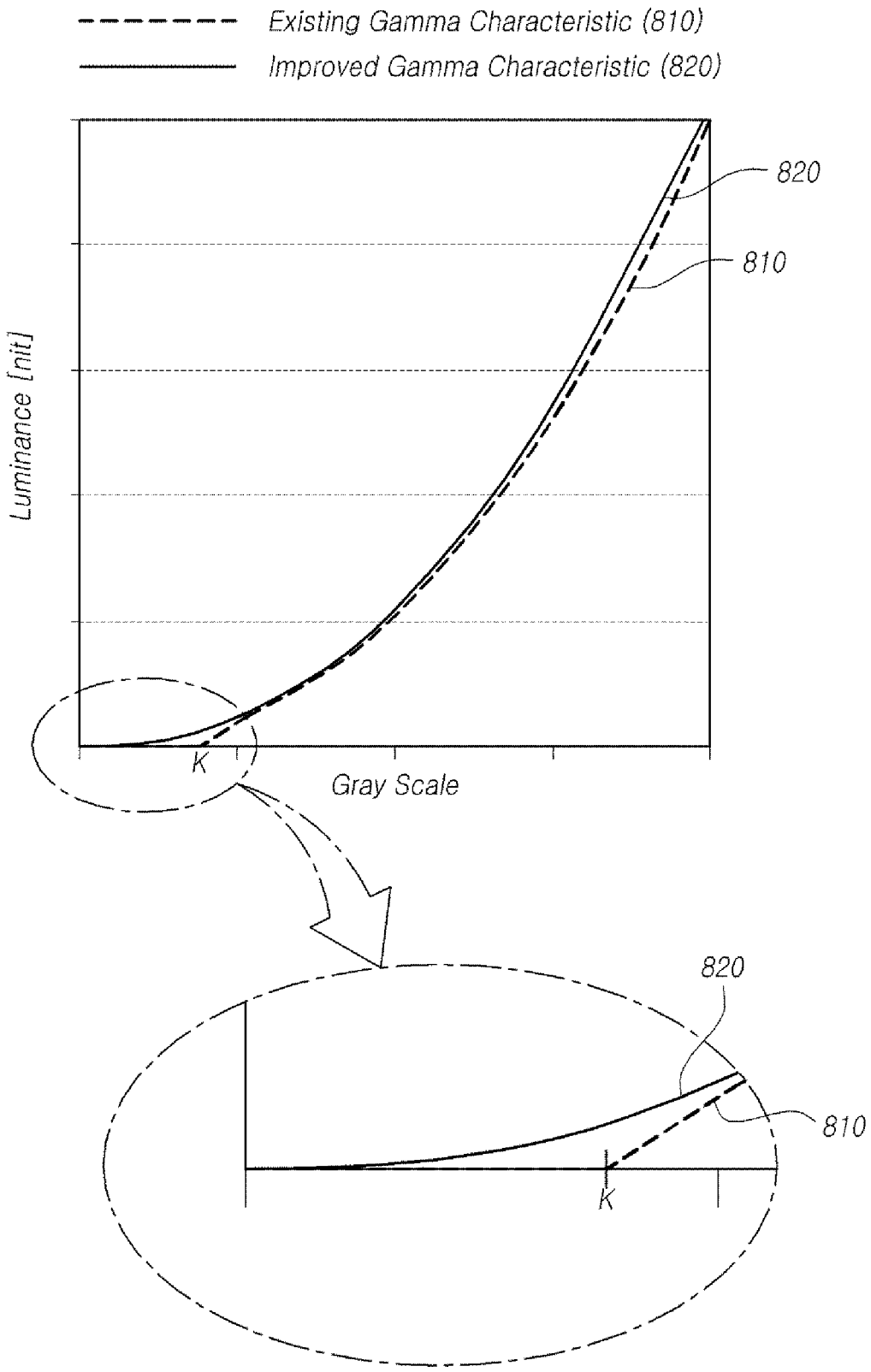
FIG. 8 is a gray scale-luminance characteristic graph illustrating a gamma characteristic improved using the method for improving the ability to express low-gray scale images of the display device according to exemplary embodiments and an existing gamma characteristic to which the method for improving the ability to express low-gray scale images is not applied.

FIG. 7 is a gray scale-luminance characteristic graph illustrating a gamma characteristic curve 720 shifted by data shifting using the method for improving the ability to express low-gray scale images of the display device 100 according to exemplary embodiments and an ideal gamma characteristic curve 710, while FIG. 8 is a gray scale-luminance characteristic graph illustrating a gamma characteristic curve 820 improved using the method for improving the ability to express low-gray scale images of the display device 100 according to exemplary embodiments and an existing gamma characteristic curve 810 to which the method for improving the ability to express low-gray scale images is not applied.

Referring to FIG. 5, the method for improving the ability to express low-gray scale images includes a data shift process S510 and a data shift compensation process S520.

The data shift process S510 is a process of shifting the gray scale of input data by K gray scale.

According to the data shift process S510, input data having n gray scale (where n is a real number equal to or greater than 0) is shifted to data having m (=n+K) gray scale greater than the n gray scale by K gray scale (where K is a positive integer).

That is, in the data shift process S510, the n gray scale of the input data is shifted to n+K gray scale.

The data shift compensation process S520 is a process of compensating for the result of the data shift processing to prevent changes in luminance due to the data shift processing.

In the data shift compensation process S520, "a shift gamma look-up table (LUT)" 500 defining the relationship between shifted gray scales and gray scales to be actually expressed is used.

The above-described method for improving the ability to express low-gray scale images may be executed by, for example, the timing controller 140 or the data driver circuit 120.

The timing controller 140 may execute the data shift process S510, while the data driver circuit 120 may execute the data shift compensation process S520.

The timing controller 140 can shift input data having n gray scale into data having m (=n+K) gray scale greater than the n gray scale by K gray scale and then transfer the m gray scale data to the data driver circuit 120.

Here, the K gray scale may be a gray scale included in a low-gray scale range.

The data driver circuit 120 can receive data having the m gray scale, convert the received data into a data voltage for expressing the n gray scale, and output the data voltage to a corresponding data line DL.

According to the above-described method for improving the ability to express low-gray scale images, it is possible to express images having data having the K gray scale or less, the images having been unable to be expressed conventionally. In addition, it is possible to express images while maintaining desired levels of luminance. Consequently, it is possible to improve the ability to express images in low-gray scale ranges.

The data driver circuit 120 can convert data having m gray scale into a data voltage for expressing n gray scale (digital-to-analog conversion) by referring to the shift gamma LUT 500 that has been previously created and then output the data voltage.

The shift gamma LUT 500 defines the correlation between shifted gray scales and gray scales to be expressed.

As described above, according to the use of the shift gamma LUT 500, the process of converting the m gray scale into the data voltage for expressing the n gray scale (digital-to-analog conversion) and outputting the converted data voltage to prevent accidental changes in luminance can be efficiently executed.

Herein, K may be determined depending on the number of bits for data processing of the timing controller 140. In addition, K may be determined depending on the number of bits for data processing of each SDIC included in the data driver circuit 120.

For example, K may be determined as a value satisfying Formula 1.

$$K \geq \alpha \times 2^{B-\beta} \quad \text{[Formula 1]}$$

In Formula 1, B is the number of bits of input data, α is predetermined reference shift gray scale, and β is a predetermined reference number of bits.

For example, when α is 3 and β is 8, i.e. when reference input data is eight bits and reference shift gray scale is 3 gray scale (i.e. 3 gray scale is shifted when input data is eight bits), Formula 1 may be converted into $K \geq 3 \times 2^{B-8}$.

In this case, when the number of bits B of actually input data is 8, K may be determined among 3 or more values satisfying the formula: $K \geq 3 \times 2^{8-8} = 3$. In addition, when the number of bits of actually input data is 10, K may be determined among 12 or more values satisfying the formula: $K \geq 3 \times 2^{10-8} = 12$.

In another example, in the case that α is 12 and β is 10, i.e. in the case that reference input data is ten bits and reference shift gray scale is twelve gray scale (i.e. in the case that twelve gray scale is shifted when input data is 10 bits), Formula 1 may be converted into $K \geq 12 \times 2^{B-10}$.

In this case, when the number of bits B of actually input data is 10, K may be determined among 12 or more values satisfying the formula: $K \geq 3 \times 2^{8-10} = 12$. In addition, when the number of bits of actually input data is 12, K may be determined among 48 or more values satisfying the formula: $K \geq 12 \times 2^{12-10} = 48$.

As described above, it is possible to prevent the ability of expressing low-gray scale data from being reduced due to the limited number of bits for data processing of the timing controller 140.

In addition, since data having zero gray scale is not supposed to be expressed, the problem in which an image is not expressed due to the limited number of bits for data processing does not occur.

Thus, when input data has zero gray scale, the timing controller 140 may shift the input data having zero gray scale like data having higher gray scale or may output the input data having zero gray scale to the data driver circuit 120 without shifting the input data.

When the timing controller 140 outputs the input data having zero gray scale to the data driver circuit 120 without shifting the input data, the data driver circuit 120 receives the data having zero gray scale. In this case, the data having zero gray scale can be converted into a data voltage for expressing zero gray scale before being output.

Since data shift processing is not performed on the data having zero gray scale, the load of processing can be reduced advantageously.

Hereinafter, an exemplary method for improving the ability to express low-gray scale images will be described with reference to FIG. 6.

Referring to FIG. 6, when data shift processing is performed by setting the gray scale shift size K to 3, all gray scales other than zero gray scale, among gray scales of input data, are increased by the K gray scale.

Thus, data (input data) having 1, 2, 3, and 20 gray scales are shifted to data (output data) having 4, 5, 6, and 23 gray scales through data shift processing.

When an image is expressed using the shifted data having 4, 5, 6, and 23 gray scales, desired levels of luminance may not be produced.

In this regard, as illustrated in FIG. 7, data shift processing converts the ideal gamma characteristic curve 710 into the shifted gamma characteristic curve 720, whereby luminance is changed.

The shift gamma LUT 500 set to prevent changes in luminance due to data shift processing may be used.

Consequently, the actually-displayed gray scale comes to be the same as the initially-intended ideal gray scale.

This can be appreciated from the improved gamma characteristic curve 820 illustrated in FIG. 8 that is substantially identical to the ideal gamma characteristic curve 710 illustrated in FIG. 7.

Referring to the existing gamma characteristic curve 810 illustrated FIG. 8, to which the method for improving the ability to express low-gray scale images is not applied, luminance is 0 when gray scale are equal to or less than the K gray scale. That is, in a gray scale range equal to or less than the K gray scale, no images are expressed. Here, the existing gamma characteristic curve 810 illustrated in FIG. 8 is identical to the actually-measured gamma characteristic curve 420 illustrated in FIG. 4.

However, referring to the improved gamma characteristic curve 820 to which the method for improving the ability to express low-gray scale images is applied, data having gray scale equal to or less than the K gray scale has a minute value of luminance instead of 0. Consequently, it is possible to precisely express images at gray scales equal to or less than the K gray scale.

Figure 9:
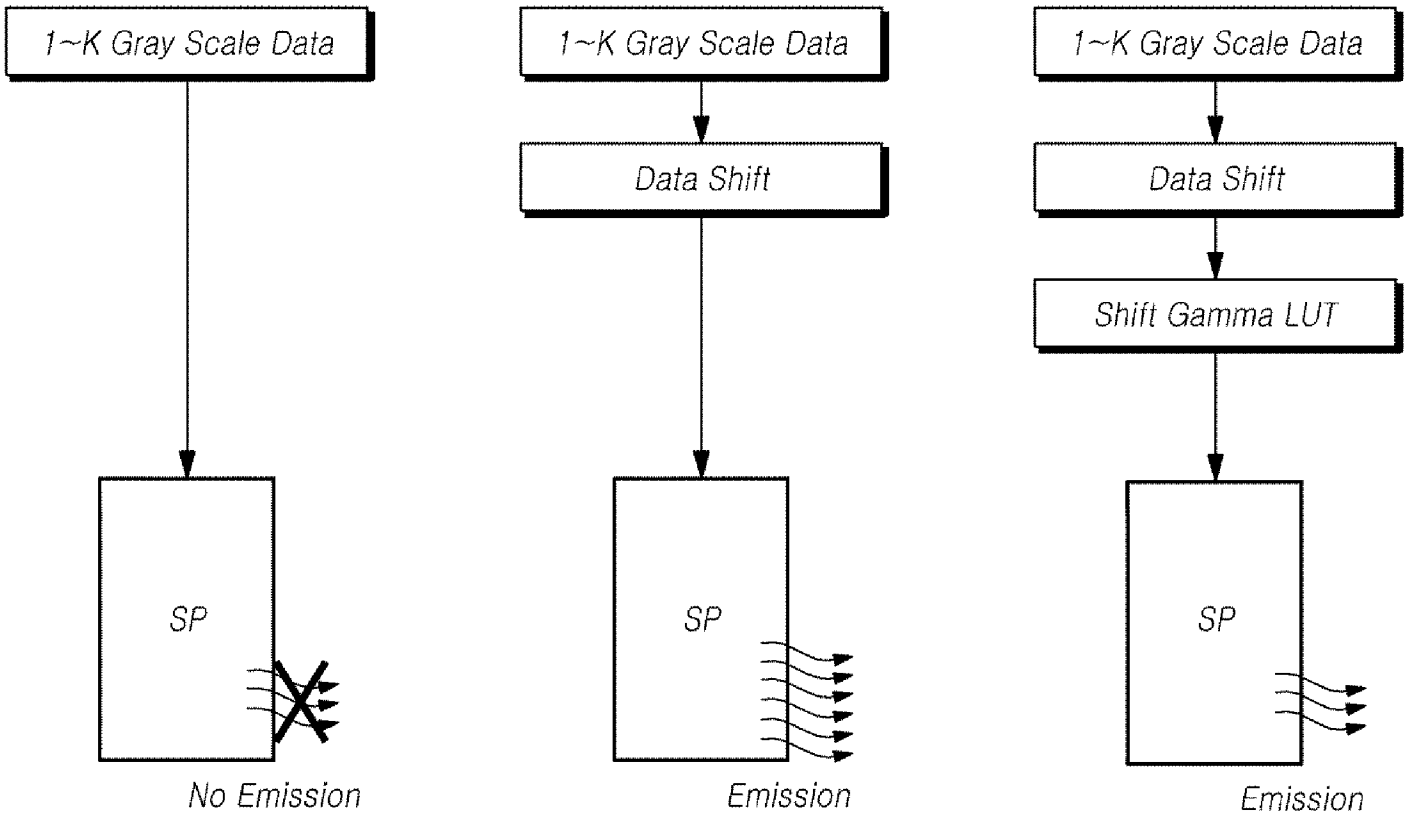
FIG. 9 illustrates light-emitting characteristics of subpixels of the display device according to exemplary embodiments to which the method for improving the ability to express low-gray scale images is applied.

FIG. 9 illustrates light-emitting characteristics of subpixels of the display device 100 according to exemplary embodiments to which the method for improving the ability to express low-gray scale images is applied.

Referring to FIG. 9, when the method for improving the ability to express low-gray scale images is not applied, i.e. neither data shift processing nor the shift gamma LUT 500 is used, a subpixel SP to which image data having 1 to K gray scales does not generate light.

In contrast, in the case that data shift processing is executed using the method for improving the ability to express low-gray scale images, when data having gray scale equal to or less than the K gray scale, i.e. data having 1 to K gray scales, is input to the timing controller 140, a subpixel SP corresponding to the data having the K gray scale or less can generate light.

However, when only data shift processing is applied, the luminance of the corresponding subpixel SP may change.

Thus, when the shift gamma LUT 500 is additionally used, the corresponding subpixel SP can generate a desired level of luminance.

Hereinafter, a method of driving the display device 100 to which the above-described method for improving the ability to express low-gray scale images is applied, as well as the timing controller 140 and the data driver circuit 120 of the display device 100, will be described briefly.

Figure 10:
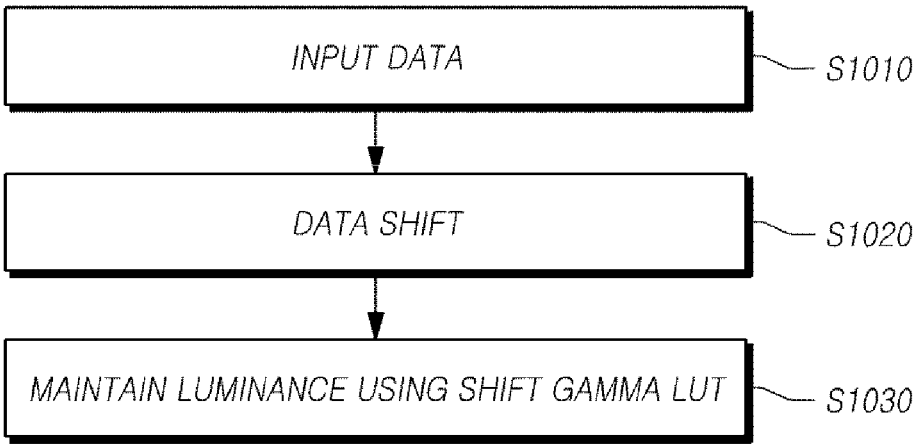
FIG. 10 is a flowchart illustrating the method of driving the display device according to exemplary embodiments.

FIG. 10 is a flowchart illustrating the method of driving the display device 100 according to exemplary embodiments.

Referring to FIG. 10, the method of driving the display device 100 according to exemplary embodiments includes: step S1010 of receiving data having n gray scale (where n is a real number equal to or greater than 0); step S1020 of shifting the data having the n gray scale to data having m (=n+K) gray scale greater than the n gray scale by K gray scale (where K is a positive integer); and step S1030 of expressing the data having the n gray scale using the data having the m gray scale by referring to the shift gamma LUT 500.

According to the above-described driving method, it is possible to express image data that have not been expressed conventionally, the image data having gray scales equal to or less than the K gray scale, by applying the method for improving the ability to express low-gray scale images. In addition, it is possible to express images while maintaining desired levels of luminance. It is thereby possible to significantly improve the ability to express low-gray scale images.

Here, step S1030 expresses the n gray scale by converting data having the m gray scale into a data voltage for expressing the n gray scale by referring to the shift gamma LUT 500 that has been previously created and outputting the data voltage to a corresponding data line DL.

It is thereby possible to prevent accidental changes in luminance due to data shift processing in step S1020.

Figure 11:
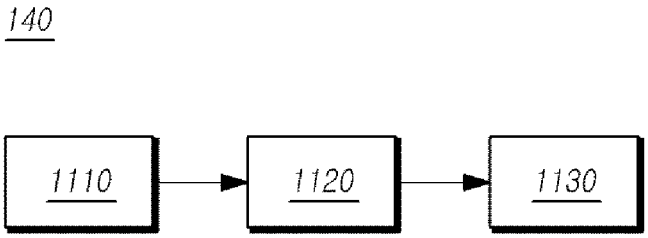
FIG. 11 is a block diagram illustrating the timing controller of the display device according to exemplary embodiments.

FIG. 11 is a block diagram illustrating the timing controller 140 of the display device 100 according to exemplary embodiments.

Referring to FIG. 11, the timing controller 140 of the display device 100 according to exemplary embodiments includes: a data input circuit 1110 receiving data having n gray scale (where n is a real number equal to or greater than 0); a data shifting circuit 1120 shifting data having the n gray scale to data having m (=n+K) gray scale greater than the n gray scale by K gray scale (where K is a positive integer); and a data output circuit 1130 outputting the data having the m gray scale.

The use of the timing controller 140 can prevent the problem in which low-gray scale images are not expressed.

Figure 12:
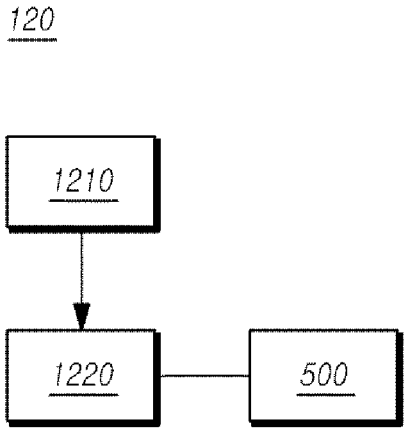
FIG. 12 is a block diagram illustrating the data driver of the display device according to exemplary embodiments.

FIG. 12 is a block diagram illustrating the data driver circuit 120 of the display device 100 according to exemplary embodiments.

Referring to FIG. 12, the data driver circuit 120 of the display device 100 according to exemplary embodiments includes a data receiving circuit 1210 and a data voltage output circuit 1220. The data receiving circuit 1210 receives data having m gray scale, while the data voltage output circuit 1220 converts the data into a data voltage for expressing n (=m−K) gray scale smaller than the m gray scale by K gray scale by referring to the shift gamma LUT 500 and outputs the data voltage to a corresponding data line DL.

The use of the driver circuit 120 can improve the accuracy of luminance while enabling images to be expressed in low-gray scale ranges due to the data shift of the timing controller 140.

As set forth above, according to exemplary embodiments, the timing controller 140, the data driver 120, the display device 100, and the method of driving the display device can improve the ability to express low-gray scale images.

In addition, according to exemplary embodiments, the timing controller 140, the data driver 120, the display device 100, and the method of driving the display device enable low-gray scale images to be expressed through data shifting.

Furthermore, according to exemplary embodiments, the timing controller 140, the data driver 120, the display device 100, and the method of driving the display device enable low-gray scale images to be expressed while obtaining desired levels of luminance.

The foregoing descriptions and the accompanying drawings have been presented in order to explain the certain principles of the present disclosure. A person skilled in the art to which the disclosure relates could make many modifications and variations by combining, dividing, substituting for, or changing the elements without departing from the principle of the disclosure. The foregoing embodiments disclosed herein shall be interpreted as illustrative only but not as limitative of the principle and scope of the disclosure. It should be understood that the scope of the disclosure shall be defined by the appended Claims and all of their equivalents fall within the scope of the disclosure.

What is claimed is:

1. A display device comprising:

a display panel on which a number of data lines, a number of gate lines, and a number of subpixels defined by the number of data lines and the number of gate lines are disposed;

a data driver circuit driving the number of data lines;

a gate driver circuit driving the number of gate lines; and a timing controller controlling the data driver circuit and the gate driver circuit, wherein the timing controller shifts data having n gray scale into data having m gray scale greater than the n gray scale by K gray scale, where the n is a real number equal to or greater than 0, the K is a positive integer, and the m is n+K, and transfers the data having the m gray scale to the data driver circuit, and wherein the data driver circuit receives and converts the data having the m gray scale to a data voltage for expressing the n gray scale by referring to a shift gamma look-up table, and outputs the data voltage for expressing the n gray scale to a corresponding data line among the number of data lines.

2. The display device according to claim 1, wherein the shift gamma look-up table defines correlations between shifted gray scales and gray scales to be expressed.

3. The display device according to claim 1, wherein, when the timing controller receives data having gray scale equal to or less than the K gray scale, a subpixel among the number of subpixels corresponding to the data having the gray scale equal to or less than the K gray scale generates light.

4. The display device according to claim 1, wherein the K gray scale is included in a low-gray scale range.

5. The display device according to claim 1, wherein the K is determined by a number of bits of input data.

6. The display device according to claim 5, wherein the K is determined among values satisfying a formula: $K \geq \alpha \times 2^{B-\beta}$, where the B is a number of bits of data input to the timing controller, the $\alpha$ is predetermined reference shift gray scale, and the $\beta$ is a predetermined reference number of bits.

7. The display device according to claim 1, wherein, when the data input to the timing controller has zero gray scale, the timing controller outputs the data having the zero gray scale to the data driver circuit without shifting the data having the zero gray scale, and the data driver circuit converts the received data having the zero gray scale into a data voltage for expressing the zero gray scale and outputs the data voltage.

8. A method of driving a display device, the display device comprising a display panel on which a number of data lines, a number of gate lines, and a number of subpixels defined by the number of data lines and the number of gate lines are disposed, a data driver circuit driving the number of data lines, a gate driver circuit driving the number of gate lines, and a timing controller controlling the data driver circuit and the gate driver circuit, the method comprising:

receiving data having n gray scale, where the n is a real number equal to or greater than 0;

shifting the data having the n gray scale into data having m gray scale greater than the n gray scale by K gray scale such that all gray scales other than zero gray scale are increased by the K gray scale, where the K is a positive integer, and the m is n+K; and converting the data having the m gray scale into a data voltage for expressing the n gray scale by referring to a shift gamma look-up table, and outputting the data voltage for expressing the n gray scale to a corresponding data line among the number of data lines.

* * * * *